US010411373B1

(12) United States Patent
Roecker

(10) Patent No.: US 10,411,373 B1
(45) Date of Patent: Sep. 10, 2019

(54) CONNECTOR FOR ESTABLISHING AN ELECTRICAL CONNECTION WITH TERMINAL BLOCKS

(71) Applicant: THE BOEING COMPANY, Chicago, IL (US)

(72) Inventor: John A. Roecker, Bellevue, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 15/940,342

(22) Filed: Mar. 29, 2018

(51) Int. Cl.

| | |
|---|---|
| ***H01R 12/51*** | (2011.01) |
| ***H01R 31/06*** | (2006.01) |
| ***H01R 43/26*** | (2006.01) |
| ***H01R 12/55*** | (2011.01) |
| ***H01R 12/70*** | (2011.01) |
| ***H01R 13/518*** | (2006.01) |

(52) U.S. Cl.
CPC ..... *H01R 12/515* (2013.01); *H01R 12/55* (2013.01); *H01R 12/7047* (2013.01); *H01R 13/518* (2013.01); *H01R 31/06* (2013.01); *H01R 43/26* (2013.01)

(58) Field of Classification Search
CPC ..... H01R 25/142; H01R 25/14; H01R 9/24; H01R 9/2691; H01R 9/2608; H01R 13/2421; H01R 13/2428; H01R 31/08; H01R 9/2491; H01R 13/6658; H01R 12/515; H01R 12/523
USPC ..... 439/709, 700, 511, 513, 638
See application file for complete search history.

(56) References Cited

U.S. PATENT DOCUMENTS

| | | | | |
|---|---|---|---|---|
| 2,788,162 A * | 4/1957 | Hitz | D06F 71/16 | 223/57 |
| 3,860,314 A * | 1/1975 | Vandiveer | G01R 1/0408 | 439/54 |
| 4,056,302 A * | 11/1977 | Braun | H05K 3/3426 | 439/692 |
| 5,641,313 A * | 6/1997 | Hohorst | H01R 9/2658 | 439/709 |
| 5,669,788 A * | 9/1997 | Brockman | H01R 9/2675 | 439/511 |

(Continued)

OTHER PUBLICATIONS

Phoenix Contact; "Plug-in terminal blocks," 2018, 2 Pages, Downloaded from the Internet, <https://www.phoenixcontact.com/online/portal/us?1dmy&urile=wcm%3apath%3a/usen/web/main/products/subcategory_pages/Plug-in_terminal_blocks_P-15-01-13/46817d77-6eed-4f70-8f4a-a646875fccb8>.

(Continued)

*Primary Examiner* — Tulsidas C Patel
*Assistant Examiner* — Marcus E Harcum
(74) *Attorney, Agent, or Firm* — Sage Patent Group

(57) ABSTRACT

A connector for establishing an electrical connection with a plurality of terminal blocks may include a fixture and a plurality of electrical contacts attached to the fixture. The electrical contacts may be configured to engage conductive screws of the plurality of terminal blocks. The electrical contacts may also be configured to be mechanically biased against the conductive screws. The connector may include a printed circuit board attached to the fixture and electrical contacts. The connector may also include a cable connector. The printed circuit board may electrically connect the cable connector to the electrical contacts. A connector system may include a plurality of such connectors. One or more securing elements may be employed to attach such connectors to one another.

20 Claims, 7 Drawing Sheets

(56) References Cited

U.S. PATENT DOCUMENTS

| | | | | | |
|---|---|---|---|---|---|
| 5,722,862 | A * | 3/1998 | Glathe | H01R 9/2658 | 439/511 |
| 5,994,989 | A * | 11/1999 | Rowe | H01R 31/08 | 335/18 |
| 6,948,949 | B1 * | 9/2005 | Schwartz | H01R 9/2491 | 439/638 |
| 7,762,852 | B2 * | 7/2010 | Daly | H01R 9/2491 | 439/562 |
| 2010/0203773 | A1 * | 8/2010 | Henke | H01R 9/2633 | 439/709 |
| 2012/0045947 | A1 * | 2/2012 | Molnar | H05K 7/1468 | 439/700 |
| 2015/0188249 | A1 * | 7/2015 | Pereira | H02J 3/38 | 307/82 |
| 2016/0181749 | A1 * | 6/2016 | Rathjen | H01R 25/142 | 439/122 |
| 2017/0256869 | A1 * | 9/2017 | Scanzillo | H01R 4/305 | |

OTHER PUBLICATIONS

Phoenix Contact; "Terminal blocks," 2018, 4 Pages, Downloaded from the Internet, <https://www.phoenixcontact.com/online/portal/us?1dmy&urile=wcm%3apath%3a/usen/web/main/products/subcategory_pages/Terminal_blocks_P-15/47841273-1e2b-4a34-8da7-709d3af232aa>.

Phoenix Contact; "Screw connection," 2018, 3 Pages, Downloaded from the Internet, <https://www.phoenixcontact.com/online/portal/us?1dmy&urile=wcm%3apath%3a/usen/web/main/products/subcategory_pages/Screw_connection_P-15-01/db7ba1fe-06e4-4673-b3bc-35cc7888a22a>.

Phoenix Contact; "UT screw connection: Clipline complete," Phoenix Contact 2017, pp. 1-32.

* cited by examiner

CONNECTOR FOR ESTABLISHING AN ELECTRICAL CONNECTION WITH TERMINAL BLOCKS

BACKGROUND

Terminal blocks are commonly used to facilitate wiring in electrical systems. Terminal blocks may provide various types of connections to facilitate this wiring. That said, a need exists for an improved way of establishing additional electrical connections with terminal blocks.

SUMMARY

In one aspect, the present disclosure embraces a connector for establishing an electrical connection with a plurality of terminal blocks, wherein each terminal block includes one or more conductive screws. In one embodiment, the connector includes a fixture and a plurality of electrical contacts attached to the fixture, each of the electrical contacts being configured to engage one of the conductive screws of the plurality of terminal blocks.

In some embodiments and in combination with any of the above embodiments, each of the plurality of electrical contacts is a spring-loaded electrical contact.

In some embodiments and in combination with any of the above embodiments, each of the plurality of electrical contacts includes an electrical prong that is mechanically biased away from the fixture.

In some embodiments and in combination with any of the above embodiments, each of the plurality of electrical contacts includes an electrical prong that is configured so that when the plurality of electrical contacts engage the conductive screws of the plurality of terminal blocks each electrical prong is mechanically biased against one of the conductive screws.

In some embodiments and in combination with any of the above embodiments, the plurality of electrical contacts are positioned along a longitudinal axis of the fixture.

In some embodiments and in combination with any of the above embodiments, the connector includes a printed circuit board attached to the fixture and the electrical contacts, wherein the plurality of electrical contacts are electrically connected to the printed circuit board. The connector may further include a cable connector attached to the printed circuit board, the printed circuit board electrically connecting the cable connector to the plurality of electrical contacts.

In some embodiments and in combination with any of the above embodiments, a cable may include the connector, wherein the connector is attached to a first end of the cable.

In a second aspect, the present disclosure embraces a connector system for establishing an electrical connection with a plurality of terminal blocks, wherein the plurality of terminal blocks include a first set of conductive screws positioned and a second set of conductive screws. In one embodiment, the connector system includes a first connector, a second connector, and one or more securing elements for attaching the first connector to the second connector. The first connector includes a fixture and a plurality of electrical contacts attached to the fixture, the plurality of electrical contacts of the first connector being configured to engage the first set of conductive screws of the plurality of terminal blocks. The second connector includes a second fixture and a plurality of electrical contacts attached to the second fixture, the plurality of electrical contacts of the second connector being configured to engage the second set of conductive screws of the plurality of terminal blocks.

In some embodiments and in combination with any of the above embodiments of the second aspect, the first set of conductive screws is positioned at a first level and the second set of conductive screws is positioned at a second level. The first and second levels may be different, and the one or more securing elements may be configured to position the first connector and second connector at different levels so that the plurality of electrical contacts of the first connector can engage the first set of conductive screws at the same time the plurality of electrical contacts of the second connector engage the second set of conductive screws.

In some embodiments and in combination with any of the above embodiments of the second aspect, each of the plurality of electrical contacts of the first connector and the second connector is a spring-loaded electrical contact.

In some embodiments and in combination with any of the above embodiments of the second aspect, each of the plurality of electrical contacts of the first connector includes an electrical prong that is mechanically biased away from the fixture, and each of the plurality of electrical contacts of the second connector includes an electrical prong that is mechanically biased away from the second fixture.

In some embodiments and in combination with any of the above embodiments of the second aspect, each of the plurality of electrical contacts includes an electrical prong that is configured so that when the plurality of electrical contacts of the first connector and the second connector engage the first set and second set of conductive screws of the plurality of terminal blocks each electrical prong is mechanically biased against one of the conductive screws.

In some embodiments and in combination with any of the above embodiments of the second aspect, the first connector includes: a printed circuit board attached to the fixture of the first connector and the electrical contacts of the first connector; and a cable connector attached to the printed circuit board of the first connector, wherein the printed circuit board of the first connector electrically connects the cable connector of the first connector to the plurality of electrical contacts of the first connector. In addition, the second connector includes: a printed circuit board attached to the fixture of the second connector and the electrical contacts of the second connector; and a cable connector attached to the printed circuit board of the second connector, wherein the printed circuit board of the second connector electrically connects the cable connector of the second connector to the plurality of electrical contacts of the second connector.

In a third aspect, the present disclosure embraces a method of establishing an electrical connection with a plurality of DIN rail terminal blocks attached to a DIN rail, each DIN rail terminal block including one or more conductive screws. In one embodiment, the method includes providing a connector that includes a fixture and a plurality of electrical contacts attached to the fixture. The method also includes connecting the connector to the plurality of DIN rail terminal blocks so that the electrical contacts engage the conductive screws of the plurality of DIN rail terminal blocks.

In some embodiments and in combination with any of the above embodiments of the third aspect, each DIN rail terminal block comprises one or more bores, each of the one or more bores being configured to receive one of the one or more conductive screws. Connecting the connector to the plurality of DIN rail terminal blocks may include inserting the electrical contacts into the one or more bores of the plurality of DIN rail terminal blocks.

In some embodiments and in combination with any of the above embodiments of the third aspect, each of the plurality of electrical contacts is a spring-loaded electrical contact.

In some embodiments and in combination with any of the above embodiments of the third aspect, each of the plurality of electrical contacts comprises an electrical prong that is configured so that when the plurality of electrical contacts engage the conductive screws of the plurality of DIN rail terminal blocks each electrical prong is mechanically biased against one of the conductive screws.

The features, functions, and advantages that have been discussed can be achieved independently in various embodiments or may be combined in yet other embodiments further details of which can be seen with reference to the following description and drawings.

BRIEF DESCRIPTION OF THE DRAWINGS

The present disclosure is further described in the detailed description which follows in reference to the noted plurality of drawings by way of non-limiting examples of embodiments of the present disclosure in which like reference numerals represent similar parts throughout the several views of the drawings and wherein.

DETAILED DESCRIPTION

Terminal blocks are commonly used to facilitate wiring in electrical systems. A terminal block typically includes a housing, a plurality of receptacles configured to receive an electrical wire, and an internal bus configured to provide an electrical connection between the receptacles. Terminal blocks may have various types of receptacles, such a plug-in receptacles and screw terminals.

Figure 1:
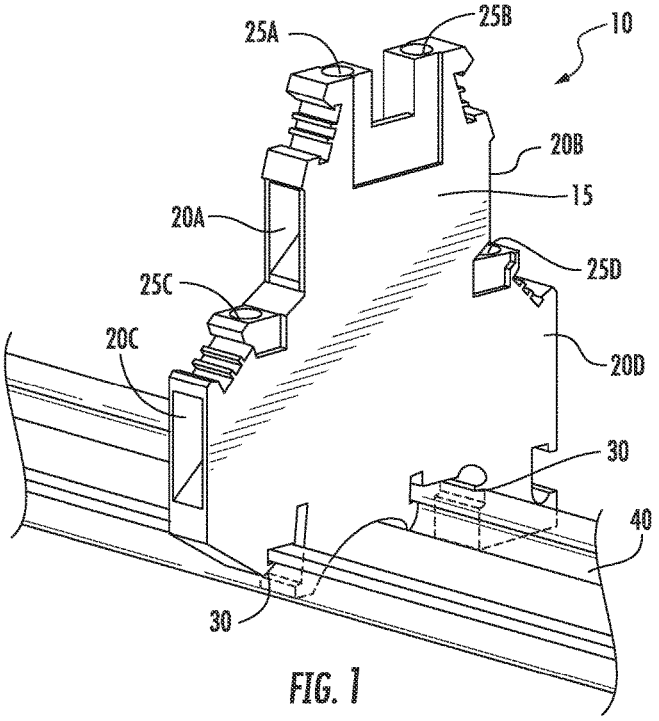
FIG. 1 depicts an exemplary terminal block.

FIG. 1 depicts an exemplary terminal block 10. The terminal block 10 includes a housing 15. The housing 15 includes first receptacles 20A-B, second receptacles 20C-D, and a plurality of complementary bores 25A-D that are configured to receive a screw. As depicted in FIG. 1, the first receptacles 20A-B and the second receptacles 20C-D may be positioned at different levels; however, in some embodiments the receptacles of a terminal block may be positioned at the same level. Inside the housing 15, the terminal block 10 includes a first internal conductor (not depicted) positioned between the first receptacles 20A-B and a second internal conductor (not depicted) positioned between the second receptacles 20C-D. Each receptacle of the terminal block 10 is configured to receive the end of an electrical wire. To provide an electrical connection between the electrical wire and the corresponding internal conductor of the terminal block 10 (e.g., between electrical wires inserted into the first receptacles 20A-B and the first internal conductor), a screw may be inserted into the applicable bore (e.g., bore 25A). The screw may then be used to hold an exposed conductor of the wire against the corresponding internal conductor of the terminal block 10.

In some embodiments, the terminal block 10 may be a DIN rail terminal block that is configured to be attached to a DIN rail 40. Accordingly, the terminal block 10 may have one or more snap-fit connectors 30 for attaching the terminal block 10 to the DIN rail 40.

Figure 2:
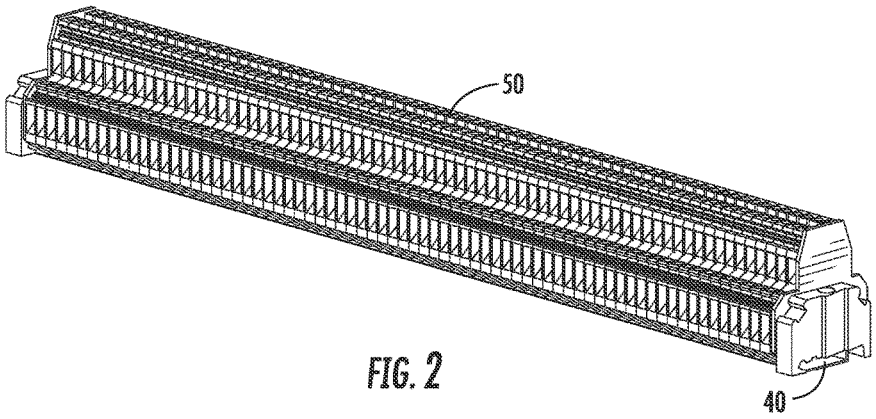
FIG. 2 depicts a set of terminal blocks positioned along a DIN rail.

Terminal blocks are often modular so that multiple terminal block may be positioned adjacent one another to facilitate wiring. In this regard, FIG. 2 depicts a set 50 of terminal blocks positioned adjacent to one another and along the DIN rail 40. Although FIG. 2 depicts each terminal block of the set 50 as being identical to the terminal block 10 depicted in FIG. 1, different types of terminal blocks may be positioned adjacent to one another.

In some instances it may be desirable to add additional and/or different types of electrical connections to an existing set of terminal blocks. For example, it may be desirable to add additional connections to a set of terminal block in order to test the integrity of existing electrical connections. To provide additional and/or different types of electrical connections, existing terminal blocks may be replaced with terminal blocks having the desired additional and/or different types of electrical connections. However, replacing existing terminal blocks may be undesirable inasmuch as rewiring the existing electrical connections may be difficult and time and labor intensive. Therefore, a need exists for a way of adding additional electrical connections to an existing set of terminal blocks without replacing the existing terminal blocks.

Therefore, in one aspect, the present disclosure embraces a connector that may be used to establish additional electrical connections with existing terminal blocks. As noted above, terminal blocks may include screw terminals in which a screw may be used to hold a wire against an internal conductor. Such screw may be formed from a conductive material. To take advantage of the conductivity of such screw, a connector of the present disclosure includes a plurality of electrical contacts that are configured to engage a conductive screw of a terminal block. By using these electrical contacts to engage the conductive screws of the terminal blocks, a connector of the present disclosure may be used to establish additional electrical connections with the terminal blocks, thereby avoiding the replacement of the terminal blocks.

Figure 3:
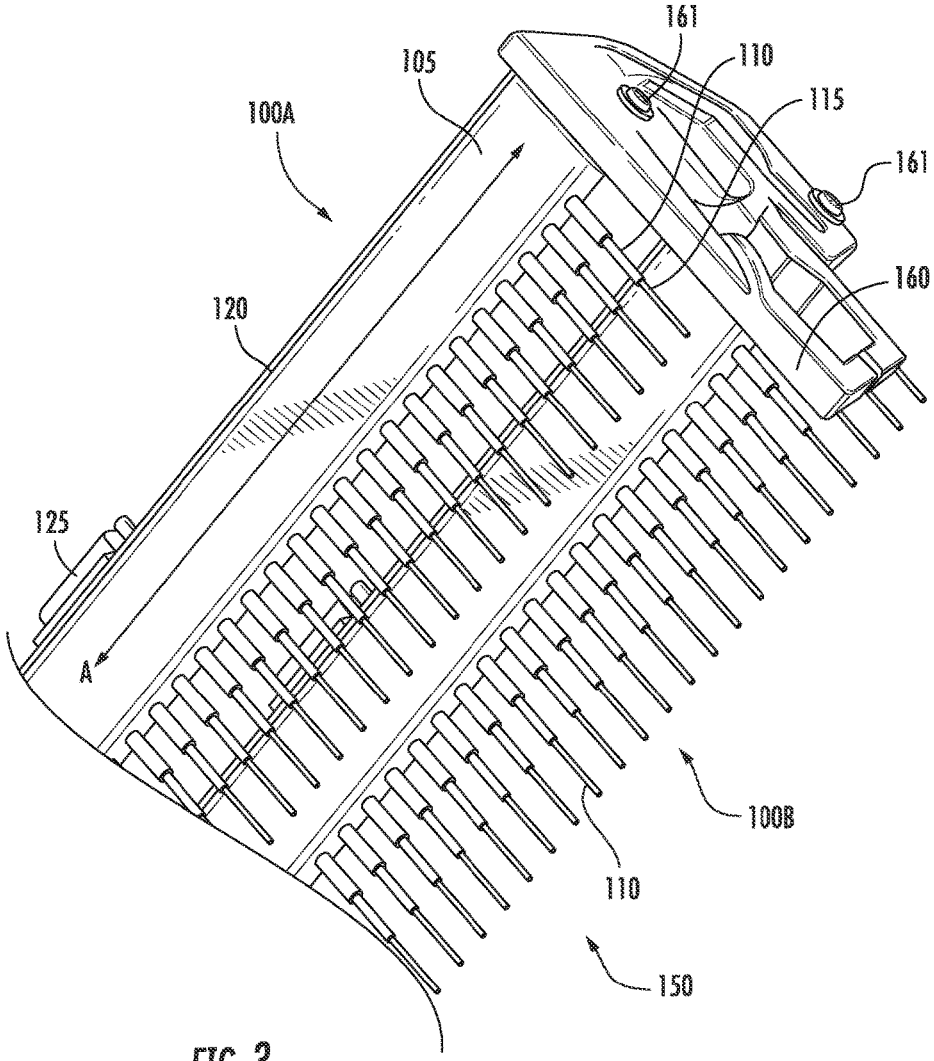
FIG. 3-4 depict exemplary connectors and an exemplary connector system in accordance with an embodiment of the present disclosure.
Figure 4:
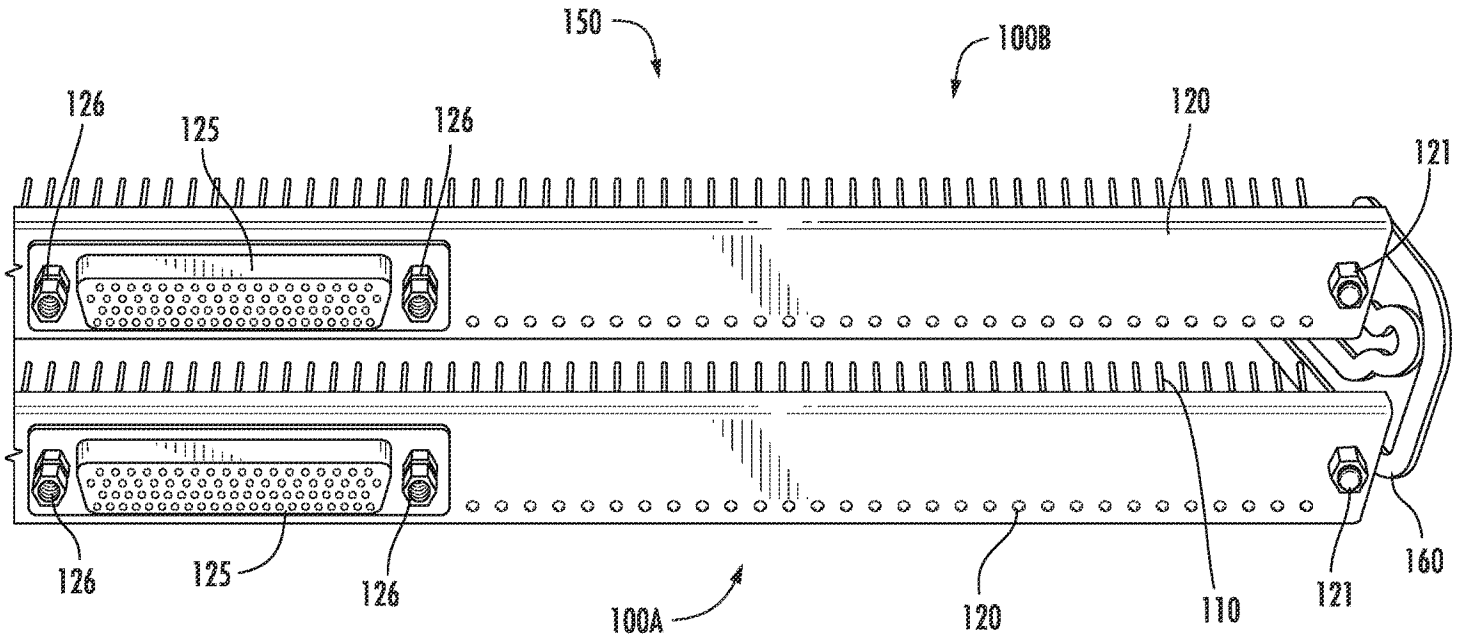

In this regard, FIGS. 3-4 depict an exemplary connector 100A in accordance with the present disclosure that may be used to establish an electrical connection with a plurality of terminal blocks (e.g., the set 50 of terminal blocks depicted in FIG. 2). The connector 100A typically includes a fixture 105. The fixture 105 is typically formed from a non-conductive material, such as a polymeric (e.g., an ultraviolet curable plastic) or other suitable material.

The connector 100A also typically includes a plurality of electrical contacts 110. Each electrical contact 110 is typically configured to engage a conductive screw of a terminal block (e.g., the terminal block 10 depicted in FIG. 1). In this regard, each electrical contact 110 typically has a diameter that is less the diameter of the bores of the terminal block. Moreover, each electrical contact 110 typically has a length sufficient to extent through the bore to engage the screw.

In some embodiments, each electrical contact 110 is configured to be mechanically biased against a conductive screw of a terminal block when such electrical contact 110 engages such conductive screw. In this regard, each electrical contact 110 may include an electrical prong 115 that is mechanically biased (e.g., via a spring) away from the fixture and toward a conductive screw. By way of example, each electrical contact 110 may be a spring-loaded electrical contact. That said, any other type of electrical contact that can be mechanically biased against the conductive screws of the terminal blocks is within the scope of the present disclosure. Mechanically biasing the electrical contacts 110 against the conductive screws of the terminal blocks helps to maintain an electrical connection therebetween and account for potential height differences of the conductive screws.

As depicted in FIG. 3, the electrical contacts 110 may be positioned along a longitudinal axis A of the fixture 105 (e.g., to facilitate connections with adjacent terminal blocks). Also as depicted in FIG. 3, adjacent electrical contacts 110 may be positioned approximately equidistant from one another. The distance between adjacent electrical contacts 110 is typically based on the distance between bores of adjacent terminal blocks. For example, adjacent electrical contacts 110 may be positioned approximately 6.2 millimeters apart. Notwithstanding the foregoing, depending on the type and orientation of the terminal blocks, other orientations (e.g., other than the linear orientation depicted in FIG. 3) of the electrical contacts 110 are within the scope of the present disclosure.

In some embodiments, the connector 100A may include a cable connector 125 that is electrically connected to the electrical contacts 110. The cable connector 125 may be attached to the fixture 105 by one or more screws 126. The connector 100A may further include a printed circuit board 120 that is attached to the fixture 105 (e.g., via one or more screws 121) and to the electrical contacts 110. The electrical contacts 110 may be electrically connected to the printed circuit board 120, and the printed circuit board may electrically connect the cable connector 125 to the electrical contacts 110. By including the cable connector 125, the connector 100A may function as an adapter between a cable and the terminal blocks.

Figure 5:
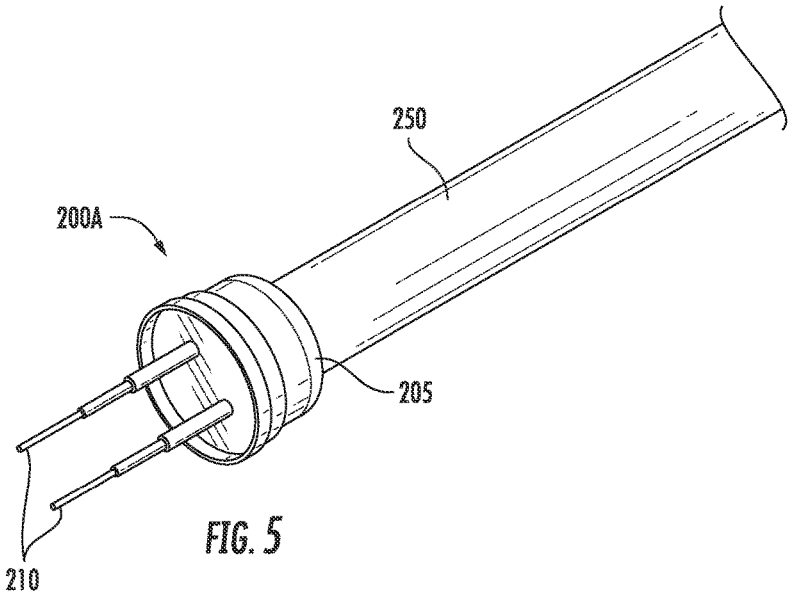
FIG. 5 depicts an exemplary connector attached to the end of a cable in accordance with an embodiment of the present disclosure.
Figure 6:
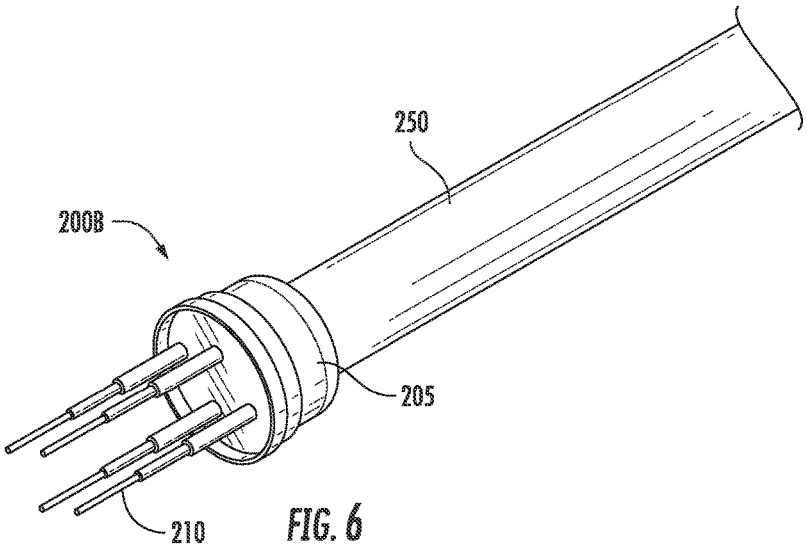
FIG. 6 depicts an exemplary connector attached to the end of a cable in accordance with another embodiment of the present disclosure.

In other embodiments the connector described herein may be part of a cable. In this regard, FIGS. 5-6 depict connectors 200A, 200B attached to a cable 250. The connectors 200A, 200B include a fixture 205 attached to an end of the cable. In addition, connectors 200A, 200B include a plurality of electrical contacts 210 (e.g., spring-loaded electrical contacts) attached to the fixture 205. In additional, each electrical contact 110 is electrically connected to a conductor (not depicted) of the cable 250. Each of the electrical contacts is configured to engage a conductive screw of a terminal blocks as described in more detail herein. Similar to the connector 100A depicted in FIGS. 3-4, FIG. 5 depicts the electrical contacts 210 being positioned in a linear orientation. However, as depicted in FIG. 6 and depending on the orientation of the conductive screws of applicable terminal blocks, other orientations of the electrical contacts 210 are possible.

Returning to FIGS. 3-4, these FIGS. 3-4 also depict a connector system 150 in accordance with an embodiment of the present disclosure. The connector system 150 typically includes a plurality of connectors (e.g., the connector 100A depicted in FIGS. 3-4) as described herein. As depicted in FIGS. 3-4, the connector system 150 may include the connector 100A (also referred to as the first connector) and a second connector 100B. In some embodiments, the first and second connectors 100A-B are substantially identical.

The first and second connectors 100A-B are typically attached to one another by one or more securing elements. As depicted in FIGS. 3-4, a securing element 160 (e.g., an end piece) may be attached to each end of the first and second connectors 100A-B, and a plurality of screws 161 may be used to secure each securing element 160 to the first and second connectors 100A-B.

Figure 7:
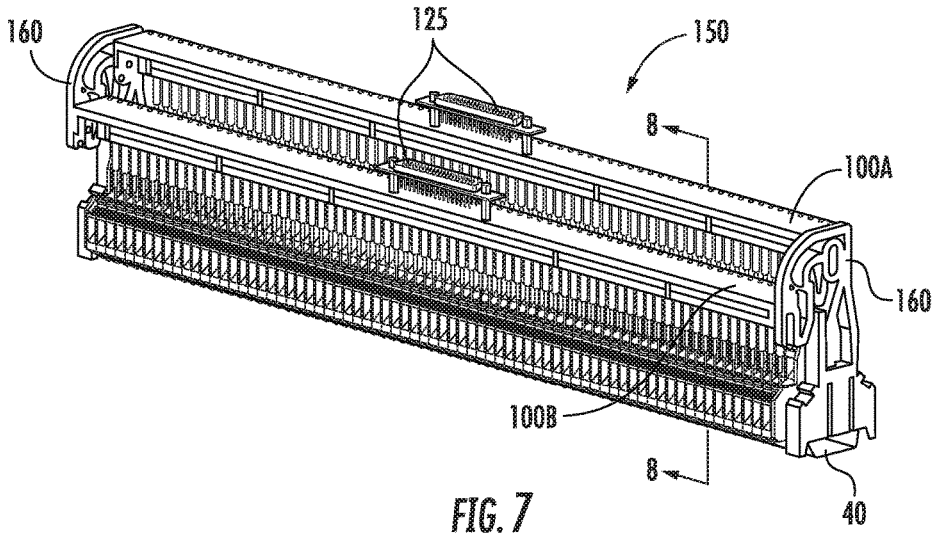
FIGS. 7, 8A, and 8B depict the electrical contacts of the connector system of FIGS. 3-4 being inserted into bores of the set of terminal blocks depicted in FIG. 2 to engage conductive screws therein.
Figure 8A:
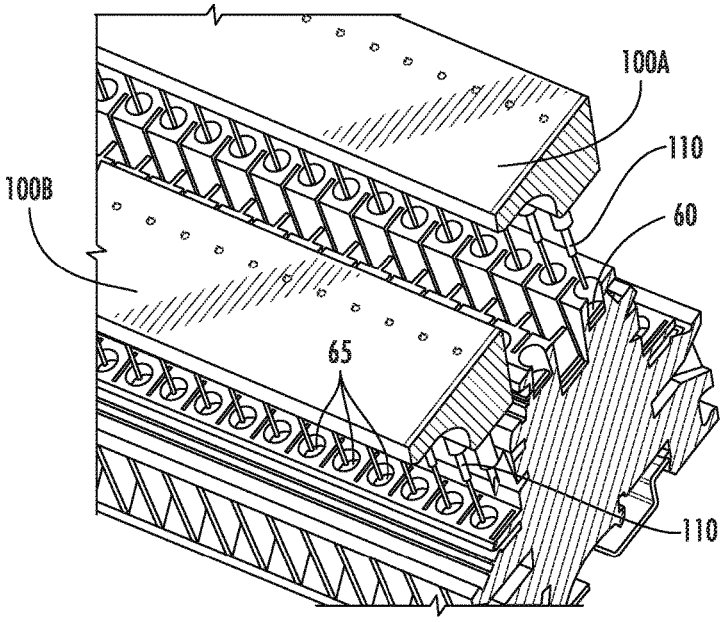
Figure 8B:
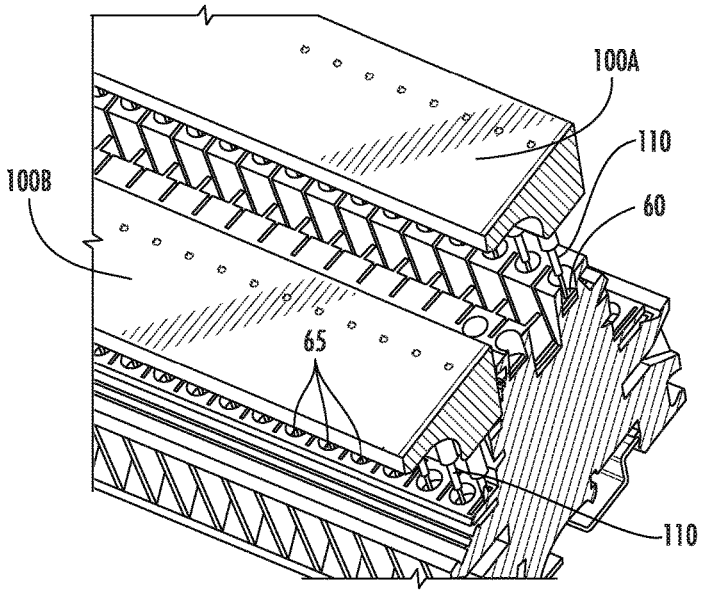

The first and second connectors 100A-B are typically employed to connect to different sets of conductive screws of the terminal blocks. These different sets of conductive screws may be located at different levels. In this regard, FIGS. 7, 8A, and 8B depict the electrical contacts 110 of first and second connectors 100A, 100B being inserted into bores of the set 50 of terminal blocks so that the electrical contacts 110 of the first connector 100A engage a first set of conductive screws 60 and the electrical contacts 110 of the second connector 100B engage a second set of conductive screws 65. As depicted in FIGS. 7, 8A, and 8B, the first and second sets of conductive screws 60, 65 are positioned at different levels. Accordingly, the securing elements 160 may be configured to position the first connector 100A and the second connector 100B at such different levels so that the electrical contacts 110 of the first connector 100A can engage the first set of conductive screws 60 and the electrical contacts 110 of the second connector 100B can engage the second set of conductive screws 65.

Figure 9:
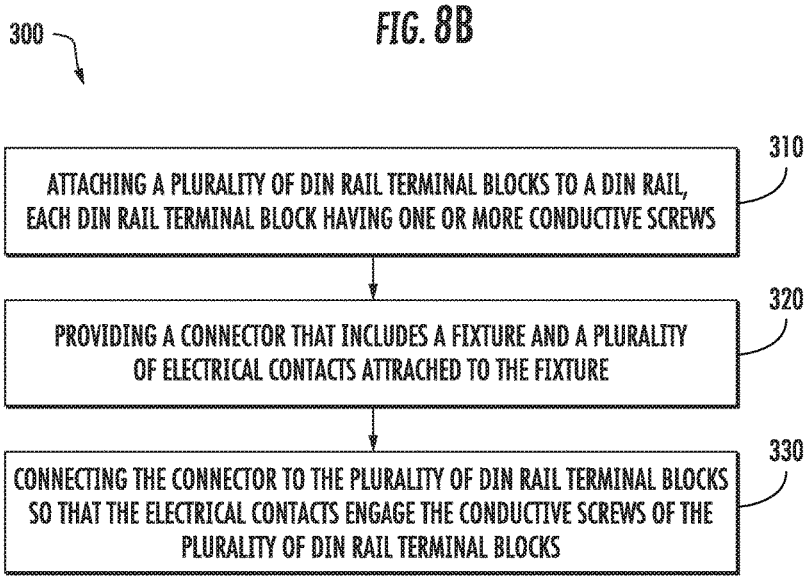
FIG. 9 depicts an exemplary method of establishing an electrical connection with a plurality of terminal blocks in accordance with an embodiment of the present disclosure.

FIG. 9 depicts a method 300 of establishing an electrical connection with a plurality of terminal blocks in accordance with an embodiment of the present disclosure.

Initially, at block 310, a plurality of DIN rail terminal blocks (e.g., the set 50 of terminal blocks depicted in FIG. 2) are attached to a DIN rail (e.g., the DIN rail 40 depicted in FIG. 2). Each DIN rail terminal block typically has one or more conductive screws. As described herein, these conductive screws may be positioned at different levels.

Subsequently, at block 320 a connector (e.g., the first connector 100A) is provided. As described herein, the connector typically includes a fixture and a plurality of electrical contacts attached to the fixture. In some embodiments, providing the connector includes providing a connector system, such as the connector system 150 depicted in FIGS. 3-4 and 5-6.

At block 330, the connector is (or connectors of a connector system are) connected to the DIN rail terminal blocks so that the electrical contacts of the connector engage the conductive screws of the DIN rail terminal blocks. In this regard, the electrical contacts are typically inserted into the bores of the DIN rail terminal blocks so that the electrical contacts can engage the conductive screws positioned in the bores.

Figure 10:
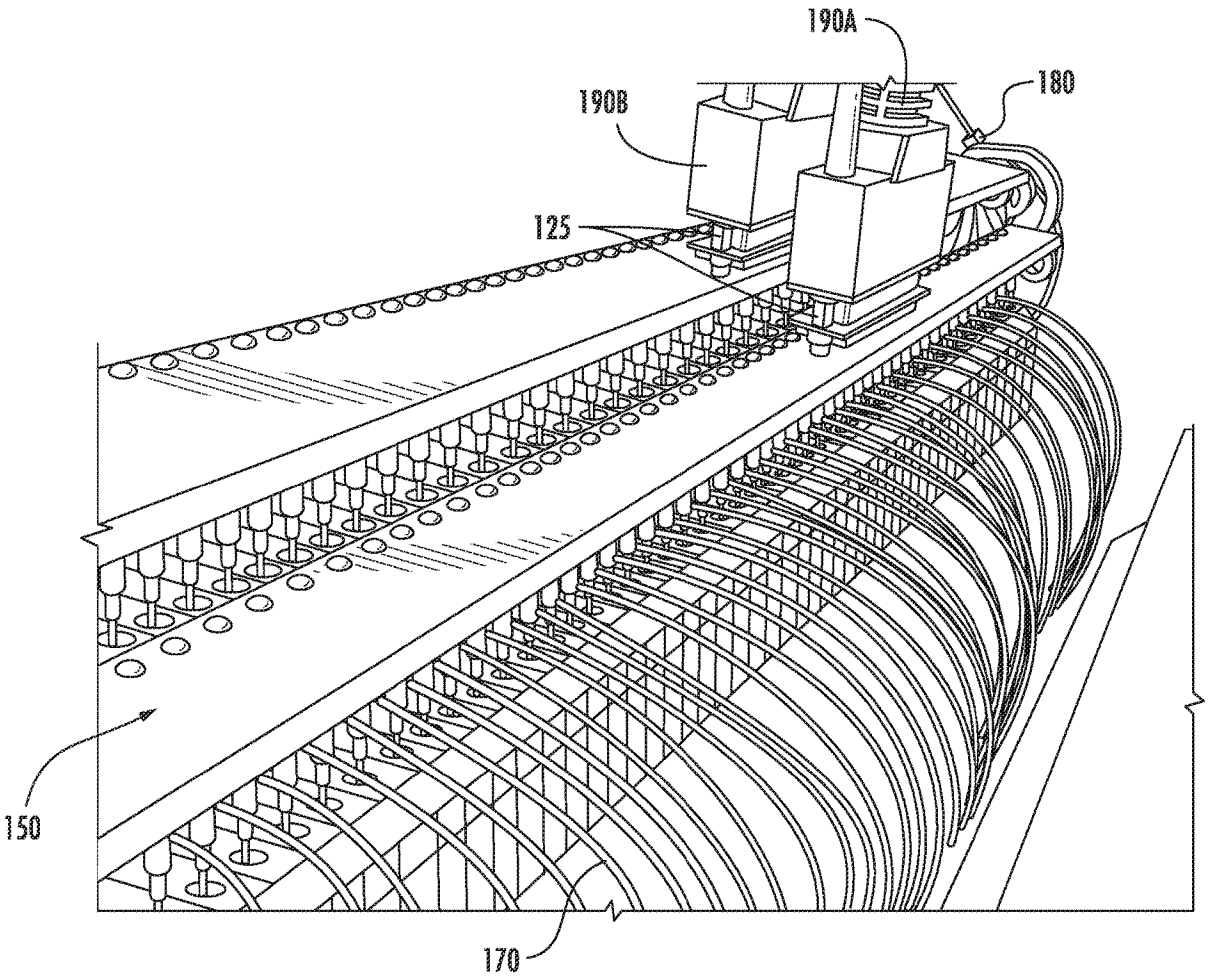
FIG. 10 depicts the connector system of FIGS. 3-4 once such connector system has been connected to the set of terminal blocks depicted in FIG. 2.

FIG. 10 depicts the connector system 150 depicted in FIGS. 3-4 once the connector system 150 has been connected to the set 50 of terminal blocks depicted in FIG. 2. FIG. 10 depicts a plurality of wires 170 inserted into receptacles of the set 50 of terminal blocks. Although these wires 170 are not depicted in FIG. 2 and FIGS. 3-4, wires are typically inserted into the receptacles of the terminal blocks prior to a connector or connector system being connected to such terminal blocks.

In some embodiments, connecting the connector or connector system to the terminal blocks includes mechanically securing the connector or connector system to the terminal blocks. In this regard, FIG. 10 depicts a cable tie 180 being used to secure the connector system 150 to the DIN rail 40. That said, a snap-fit connector or other mechanical connector may be employed to mechanically securing the connector or connector system to the terminal blocks.

In some embodiments, once the connector or connector system has been connected to the terminal blocks, a cable may be connected to a cable connector of the connector or connector system. Alternatively, such cable may be connected to the cable connector of the connector or connector system before such connector or connector system is connected to the terminal blocks. FIG. 10 depicts cables 190A, 190B being connected to the cable connectors 125 of the connector system 150.

The connector and connector system in accordance with the present disclosure allow an individual to provide additional and/or different types of electrical connections to existing terminal blocks, thereby avoiding time and labor intensive replacement of such existing terminal blocks with terminal blocks having the desired additional and/or different types of electrical connections.

The flowchart and block diagrams in the figures illustrate the functionality and operation of possible implementations of apparatuses, systems, and methods according to various embodiments of the present disclosure. In some alternative implementations, the steps noted in the blocks of the flowchart and block diagrams may occur out of the order noted in the figures. For example, two blocks shown in succession may, in fact, be performed substantially concurrently, or the blocks may sometimes be performed in the reverse order, depending upon the steps involved.

The terminology used herein is for the purpose of describing particular embodiments only and is not intended to be limiting of embodiments of the disclosure. As used herein, the singular forms "a", "an", and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Furthermore, when it is said herein that something is "based on" something else, it may be based on one or more other things as well. In other words, unless expressly indicated otherwise, as used herein "based on" means "based at least in part on" or "based at least partially on."

The corresponding structures, materials, acts, and equivalents of all means or step plus function elements in the claims below are intended to include any structure, material, or act for performing the function in combination with other claimed elements as specifically claimed. The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

Although specific embodiments have been illustrated and described herein, those of ordinary skill in the art appreciate that any arrangement which is calculated to achieve the same purpose may be substituted for the specific embodiments shown and that embodiments of the disclosure have other applications in other environments. This application is intended to cover any adaptations or variations of the present disclosure. The following claims are in no way intended to limit the scope of embodiments of the disclosure to the specific embodiments described herein.

What is claimed is:

1. A connector for establishing an electrical connection with a plurality of terminal blocks, wherein each terminal block comprises one or more conductive screws, the connector comprising:

a fixture; and a plurality of electrical contacts attached to the fixture, each of the electrical contacts being configured to engage one of the conductive screws of the plurality of terminal blocks, wherein each of the plurality of electrical contacts comprises an electrical prong that is configured so that when the plurality of electrical contacts engage the conductive screws of the plurality of terminal blocks each electrical prong is mechanically biased against one of the conductive screws.

2. The connector according to claim 1, wherein each of the plurality of electrical contacts is a spring-loaded electrical contact.

3. The connector according to claim 1, wherein each of the plurality of electrical contacts comprises an electrical prong that is mechanically biased away from the fixture.

4. The connector according to claim 1, wherein the plurality of electrical contacts are positioned along a longitudinal axis of the fixture.

5. The connector according to claim 1, comprising a printed circuit board attached to the fixture and the electrical contacts, wherein the plurality of electrical contacts are electrically connected to the printed circuit board.

6. The connector according to claim 5, comprising a cable connector attached to the printed circuit board, the printed circuit board electrically connecting the cable connector to the plurality of electrical contacts.

7. A cable, comprising the connector according to claim 1, the connector being attached to a first end of a cable.

8. A connector system for establishing an electrical connection with a plurality of terminal blocks, wherein the plurality of terminal blocks comprise a first set of conductive screws positioned and a second set of conductive screws, the connector system comprising:

a first connector, the first connector comprising:

a fixture; and a plurality of electrical contacts attached to the fixture, the plurality of electrical contacts of the first connector being configured to engage the first set of conductive screws of the plurality of terminal blocks;

a second connector, the second connector comprising:

a second fixture; and a plurality of electrical contacts attached to the second fixture, the plurality of electrical contacts of the second connector being configured to engage the second set of conductive screws of the plurality of terminal blocks; and one or more securing elements for attaching the first connector to the second connector.

9. The connector system according to claim 8, wherein the first set of conductive screws is positioned at a first level and the second set of conductive screws is positioned at a second level.

10. The connector system according to claim 9, wherein: the first and second levels are different; and the one or more securing elements are configured to position the first connector and second connector at different levels so that the plurality of electrical contacts of the first connector can engage the first set of conductive screws at the same time the plurality of electrical contacts of the second connector engage the second set of conductive screws.

11. The connector system according to claim 8, wherein each of the plurality of electrical contacts of the first connector and the second connector is a spring-loaded electrical contact.

12. The connector system according to claim 8, wherein each of the plurality of electrical contacts of the first connector comprises an electrical prong that is mechanically biased away from the fixture, and wherein each of the plurality of electrical contacts of the second connector comprises an electrical prong that is mechanically biased away from the second fixture.

13. The connector system according to claim 8, wherein each of the plurality of electrical contacts comprises an electrical prong that is configured so that when the plurality of electrical contacts of the first connector and the second connector engage the first set and second set of conductive screws of the plurality of terminal blocks each electrical prong is mechanically biased against one of the conductive screws.

14. The connector system according to claim 8, wherein: the first connector comprises:

a printed circuit board attached to the fixture of the first connector and the electrical contacts of the first connector; and a cable connector attached to the printed circuit board of the first connector, wherein the printed circuit board of the first connector electrically connects the cable connector of the first connector to the plurality of electrical contacts of the first connector; and the second connector comprises:

a printed circuit board attached to the fixture of the second connector and the electrical contacts of the second connector; and a cable connector attached to the printed circuit board of the second connector, wherein the printed circuit board of the second connector electrically connects the cable connector of the second connector to the plurality of electrical contacts of the second connector.

15. A method of establishing an electrical connection with a plurality of rail terminal blocks attached to a rail, each rail terminal block comprising one or more conductive screws, the method comprising:

providing a connector, the connector comprising:

a fixture; and a plurality of electrical contacts attached to the fixture, wherein each of the plurality of electrical contacts comprises an electrical prong that is configured so that when the plurality of electrical contacts engage the conductive screws of the plurality of rail terminal blocks each electrical prong is mechanically biased against one of the conductive screws; and connecting the connector to the plurality of rail terminal blocks so that the electrical contacts engage the conductive screws of the plurality of rail terminal blocks.

16. The method according to claim 15, wherein each rail terminal block comprises one or more bores, each of the one or more bores being configured to receive one of the one or more conductive screws.

17. The method according to claim 16, wherein connecting the connector to the plurality of rail terminal blocks comprising inserting the electrical contacts into the one or more bores of the plurality of rail terminal blocks.

18. The method according to claim 15, wherein each of the plurality of electrical contacts is a spring-loaded electrical contact.

19. A connector for establishing an electrical connection with a plurality of terminal blocks, wherein each terminal block comprises one or more conductive screws, the connector comprising:

a fixture;

a plurality of electrical contacts attached to the fixture, each of the electrical contacts being configured to engage one of the conductive screws of the plurality of terminal blocks, wherein each of the plurality of electrical contacts comprises an electrical prong that is configured so that when the plurality of electrical contacts engage the conductive screws of the plurality of terminal blocks each electrical prong is mechanically biased against one of the conductive screws;

a printed circuit board attached to the fixture and the electrical contacts, wherein the plurality of electrical contacts are electrically connected to the printed circuit board; and a cable connector attached to the printed circuit board, the printed circuit board electrically connecting the cable connector to the plurality of electrical contacts.

20. The connector according to claim 19, wherein each of the plurality of electrical contacts is a spring-loaded electrical contact.

* * * * *